US006403956B1

(12) United States Patent
Sinha

(10) Patent No.: US 6,403,956 B1
(45) Date of Patent: Jun. 11, 2002

(54) TEMPERATURE COMPENSATION FOR MINIATURIZED MAGNETIC SECTOR

(75) Inventor: Mahadeva P. Sinha, Temple City, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/302,752

(22) Filed: Apr. 30, 1999

Related U.S. Application Data

(60) Provisional application No. 60/083,817, filed on May 1, 1998.

(51) Int. Cl.[7] ..... H01J 49/30
(52) U.S. Cl. ..... 250/298; 335/211; 335/217
(58) Field of Search ..... 250/298, 296, 250/294, 396 ML; 335/211, 217

(56) References Cited

U.S. PATENT DOCUMENTS

| | | | | | |
|---|---|---|---|---|---|
| 2,309,414 | A | * | 1/1943 | Nobbs | 335/217 |
| 4,182,984 | A | * | 1/1980 | MacFadden et al. | 335/217 |
| 4,456,898 | A | * | 6/1984 | Frischmann | 335/217 |
| 5,264,813 | A | * | 11/1993 | Byers, Jr. | 335/217 |
| 5,313,061 | A | * | 5/1994 | Drew et al. | 250/298 |

* cited by examiner

*Primary Examiner*—Jack Berman
(74) *Attorney, Agent, or Firm*—Fish & Richardson P.C.

(57) ABSTRACT

Temperature compensation for a magnetic sector used in mass spectrometry. A high temperature dependant magnetic sector is used. This magnetic sector is compensated by a magnetic shunt that has opposite temperature characteristics to those of the magnet.

10 Claims, 1 Drawing Sheet

TEMPERATURE COMPENSATION FOR MINIATURIZED MAGNETIC SECTOR

CROSS REFERENCE TO RELATED APPLICATIONS

This application claims the benefit of the U.S. Provisional Application No. 60/083,817, filed on May 1, 1998.

STATEMENT AS TO FEDERALLY SPONSORED RESEARCH

The invention described herein was made in the performance of work under a NASA contract, and is subject to the provisions of Public Law 96-517 (35 U.S.C. 202) in which the Contractor has elected to retain title.

BACKGROUND

It is highly desirable to miniaturize a mass spectrometer for both space and terrestrial applications. This enables the instrument to be brought into the field environment for making measurements. The largest and heaviest part of a sector-type mass spectrometer is often the magnet. The magnet carries out a function in separating the ions.

The present system teaches a highly miniaturized mass spectrometer including a highly miniaturized magnet made of a new magnetic material and a temperature-sensitive magnetic shunt that compensates for the variation of magnetic field with temperature.

SUMMARY

According to the present system, a special magnetic shunt is used which adjusts the magnetic properties of the main magnet. That magnetic shunt has opposite temperature characteristics to the temperature characteristics of the material used for the main magnet. As such, it compensates the main magnet for temperature variations. Effectively, therefore, this enables use of materials which have a very large temperature dependance.

DESCRIPTION OF THE PREFERRED EMBODIMENTS

GCMS systems have historically been extremely large and unwieldy devices. They need high power for operation and have been extremely high in cost.

Figure 1:
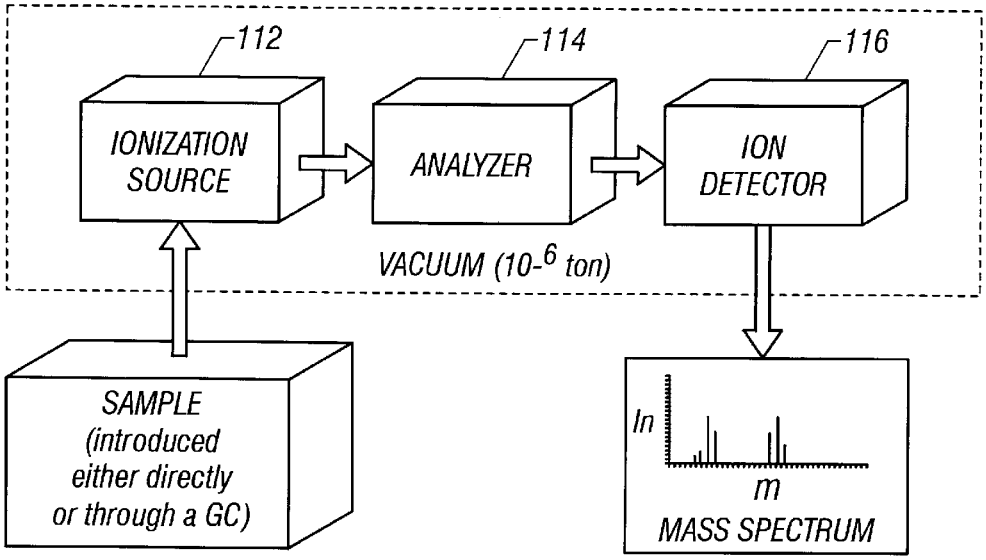
FIG. 1 shows a prior art mass spectrometer.

A mass spectrometer operates by ionizing a gaseous/vapor sample of material. FIG. 1 shows sample vapor being introduced into the ionization source 112 either directly, or more preferably, through a gas chromatograph 110. The gas chromatograph is preferably used for a complex mixture.

The ion source is maintained under vacuum at a pressure of approximately $10^{-5}$ torr with a vacuum pump. The sample molecules are bombarded with a beam of electrons in the ionization source. The process results in the production of ions of various masses depending on the chemical nature of the sample molecules. The ions are then separated according to their masses (charge to mass ratios) by the application of electric and/or magnetic fields. Intensities of different mass ions are measured by using a detector system 116.

The gas chromatograph portion of a GC mass spectrometer has typically used a coated capillary tube. The tube is coated with polymeric materials. An inert carrying gas is passed through the capillary tube. The elements of interest—collectively called the analyte—is passed into the inert carrying gas. Each of the components of interest within the analyte have different affinities with the coating on the capillary tube. This affinity changes the flow velocities of the passage of those components down the capillary column.

Normally the operation progresses as follows. The inert gas is continuously flowing through the capillary tube. A measurement cycle is initiated by adding a "slug" of analyte. The analyte includes components with different affinities with the coating. Those different affinities change the velocity of the different components of the analyte. The different components hence arrive at the output of the gas chromatograph at different moments. Each element arriving at the output is analyzed by the mass spectrometer.

The gas chromatograph tubing has typically been a 250–500 micron diameter tubing with 2–5 atm·cm$^3$/s of gas flowing therethrough. This volume of gas through the gas chromatograph enters into the mass spectrometer and necessitates a large vacuum pump with high pumping speed to maintain the proper low pressure within the mass spectrometer. An object of the present invention is to minimize the amount of gas which flows therethrough.

The inventor recognized that amount of gas which flows through the column can be reduced by narrowing its diameter. However, the art has generally suggested that narrowing the pipe is undesirable. One reason why those having ordinary skill in the art previously have not narrowed the diameter is because of the problems associated with narrowed GC effluent peaks. When the diameter of the column of a gas chromatograph is narrowed, the peak-widths of analytes emerging from the column are also narrow.

Mass spectrometers can be of a scanning-type or of a non-scanning-type (focal plane type). A scanning-type MS separates the different mass ions in time. Each intensity is measured successively by a single element detector. The ions of all the other masses are discarded during the time while the intensity of one mass is measured. A focal plane type MS, in contrast, spatially separates ions of the different masses. The intensities of these spatially-separated ions are measured simultaneously with a photographic plate, or an array detector, having multiple elements, of high sensitivity and spatial resolution.

A block of the scanning type mass spectrometer is shown in FIG. 1. The quadrupole mass spectrometer shown in the figure is a typical example of this type of MS. Ions are produced from an ion source 112 and the output ions enter an analyzer 114 which includes a tuned cavity. Cavity is tuned to allow only a single mass ion to pass; all the other untuned ion masses are discarded in order to resolve only the tuned mass ions. The tuning of the cavity is scanned over time. This means that different ion masses are successively allowed to pass at different times. At any given time, therefore, only a single ion mass will hit the detector 116 e.g., an electron multiplier. The intensity of the ions measured by the detector, therefore, indicates the amount of ions of that mass in the sample.

Scanning over the whole mass spectrum enables determination of a plot of mass versus intensity. Each particular material is formed from a unique combination of different masses and their intensities. The combination is called a mass spectrum 118. Thus, the scanning plot (mass spectrum) provides the chemical nature of the material.

Scanning-type devices de-tune most of the ions at any given time. Hence, most of the signal generated from a sample is deliberately lost prior to detection. These devices have limited scan rate and possess relatively low sensitivity.

The focal plane type of mass spectrometer spectrally analyzes all the different mass-ions from the sample at once. The mass spectrometers based on Mattauch-Herzog ("M-H") geometry or Dempster geometry are examples of this type of MS.

For any given magnet design, the volume and mass of the magnet is typically inversely proportional to the energy product value of the magnetic material. A typical material which has been used in the prior art is Alnico V which has an energy product of 5–6 MGOe. The new system shown in FIG. 2 uses a high energy product magnet formed of Nd—B—Fe alloy. This Nd—B—Fe alloy is used for the fabrication of the magnetic sector.

This is used with a high saturation flux yoke, e.g. one having a value of at least 15,000 G, more preferably 22,000 G made of Hiperco-51A VNiFe alloy.

In operation, however, it was found that the preferred magnetic material has not only a higher energy product, but also a higher dependence on temperature. The temperature coefficient of the remnant flux density, $TK(B_r)$ is defined as:

$$TK(B_r) = \left(\frac{1}{B_r}\right)(dB_r/dt)100(\%/K)]$$

Nd—B—Fe has a much higher temperature component than other materials which were previously used as shown by the following table:

| Material | TK ($B_r$) |
|---|---|
| Alnico V | −0.02 |
| Sm-Co | −0.04 |
| Nd-B-Fe | −0.10 |

Therefore, the sensitivity of Nd—B—Fe to temperature is 2 to 5 times greater than that of the other magnetic materials, e.g., 0.805 higher. This high-temperature coefficient requires frequent calibration during measurements to compensate for the effect of temperature.

Figure 2:
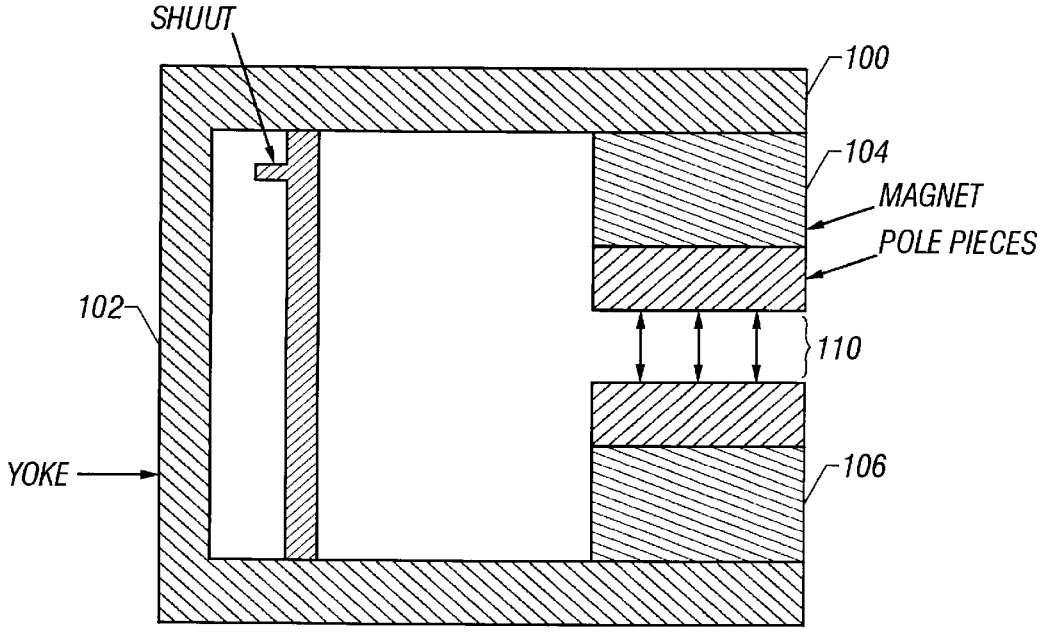
FIG. 2 shows the preferred embodiment using a magnetic shunt on a high temperature dependent magnetic material.

FIG. 2 shows the preferred temperature-stabilized magnetic sector. This system includes a magnet 100, with a yoke 102, and two pole pieces 104, 106, producing a magnetic field 110 therebetween. That magnetic field 110 separates the ions according to their masses, and hence is preferably constant.

The present system uses a magnetic shunt 120 in parallel with the magnet to produce a drastic decrease in the magnetic field variation with temperature within the gap of the magnetic sensor. By decreasing the magnetic field variation, mass calibration during the measurement is made less necessary. Moreover, this obviates the need to maintain the instrument under a controlled temperature condition.

The system uses provide a temperature-sensitive magnetic shunt in parallel with the permanent magnet. The shunt is made of a special alloy of Ni—Fe or Ni—Cr—Fe which possess negative temperature coefficient permeability. It is located close and parallel to the permanent magnet. The permeability of the special alloy increases with decrease in temperature. This compensates for the temperature variation of the magnetic field of the main magnet. The flux density in the magnet gap increases with the decrease of temperature because the magnet materials have negative temperature coefficient (as cited in the table above). As the temperature changes, the magnetic shunt releases or diverts flux lines to maintain the flux 110 constant in the magnetic gap. The magnetic shunt is preferably much smaller than the overall magnet, e.g., the magnetic shunt is preferably 10% or less, even more preferably 1% or less of the size and/or weight of the overall magnet. Therefore, the shunt produces little additional weight in the system, and as such, the overall performance of the system is improved by using the better material, however the temperature characteristics of this new material are compensated.

Although only a few embodiments have been described in detail above, other embodiments are contemplated by the inventor and are intended to be encompassed within the following claims. In addition, other modifications are contemplated and are also intended to be covered.

What is claimed is:

1. A magnetic sector for a mass spectrometer, comprising:

a magnetic element having first and second opposite poles, formed at least partially of a magnetic material which has a temperature coefficient of remnant flux density greater than 0.8%; and a magnetic shunt, having an opposite temperature coefficient to the temperature coefficient of the magnetic material, and coupled in parallel with the magnetic element between said first and second poles, to thereby divert flux lines from the magnetic element according to temperature in an opposite way to that of the magnetic element, to thereby temperature-compensate the magnetic material.

2. A device as in claim 1, wherein said magnetic material is an Nd—B—Fe alloy.

3. A device as in claim 2, further comprising a flux yoke, connected between opposite pole pieces of the magnetic material.

4. A device as in claim 3, wherein said flux yoke is a high saturation flux yoke formed of a nickel or Ni—Fe alloy.

5. A magnetic sector for a mass spectrometer, comprising:

a magnetic element having first and second opposite poles, formed at least partially of a magnetic material which has a temperature coefficient of remnant flux density greater than 0.8%; and a magnetic shunt, having an opposite temperature coefficient to the temperature coefficient of the magnetic element between said first and second poles, to thereby divert flux lines from the magnetic element according to temperature in an opposite way to the of the magnetic element, to thereby temperature-compensate the magnetic material, further comprising a magnetic yoke of a substantially U-shape, extending between the magnet parts, and forming a flux path therebetween; and wherein said magnetic shunt extends between two opposing portions of said flux pieces.

6. A temperature compensated magnetic system for a mass spectrometer, comprising:

a mass spectrometer system, producing ions to be separated according to their masses;

a magnetic element, in a path of said ions, producing a magnetic field that separates the ions according to their masses, said magnetic element formed of a magnetic portion formed of a generally U-shaped high performance magnetic material that includes an alloy of Nd—B—Fe, a yoke, extending between said legs of said magnetic material in said U shape, and forming a flux path for said magnetic material, and formed of a high saturation flux yoke material of at least 15,000 G; and a magnetic shunt, extending in parallel to said magnet, across said magnetic yoke, said magnetic shunt having an opposite temperature dependance to a temperature dependance of said magnets and located such that it compensates for magnetic effect.

7. A method of operating a mass spectrometer, comprising:

using a high performance magnet to separate ions according to their mass; and using a magnetic shunt extending between opposite poles of said magnet to compensate for temperature dependence of said magnet.

8. A magnetic sector for a mass spectrometer, comprising:

a magnetic element having first and second opposite poles, formed at least partially of a magnetic material which has a temperature coefficient of remnant flux density greater than 0.8%; and a magnetic shunt, having an opposite temperature coefficient to the temperature coefficient of the magnetic material, extending between said opposite poles, and coupled to the magnetic element, to thereby divert flux lines from the magnetic element according to temperature in an opposite way to that of the magnetic element, to thereby temperature-compensate the magnetic material, said magnetic shunt being less than 10% of a weight of a weight of said magnetic element.

9. A magnetic sector as in claim 8, wherein said magnetic shunt is less than 1 percent of a weight of said magnetic element.

10. A magnetic sector as in claim 8, wherein said magnetic shunt is coupled in parallel with the magnetic element between said first and second poles.

* * * * *